US012172810B1

(12) United States Patent
Barber

(10) Patent No.: US 12,172,810 B1
(45) Date of Patent: Dec. 24, 2024

(54) LEASH SYSTEM FOR USE WITH A BEVERAGE CONTAINER LID

(71) Applicant: Todd Richard Barber, Wilmington, NC (US)

(72) Inventor: Todd Richard Barber, Wilmington, NC (US)

( * ) Notice: Subject to any disclaimer, the term of this patent is extended or adjusted under 35 U.S.C. 154(b) by 31 days.

(21) Appl. No.: 18/130,463

(22) Filed: Apr. 4, 2023

(51) Int. Cl.
*B65D 55/16* (2006.01)

(52) U.S. Cl.
CPC ..... *B65D 55/16* (2013.01)

(58) Field of Classification Search
CPC ..... B65D 55/16
USPC ..... 215/305–306, 355–356, 364, 394, 296; 220/200, 255, 254.8, 375
See application file for complete search history.

(56) References Cited

U.S. PATENT DOCUMENTS 2,844,275 A * 7/1958 Keller ..... F01P 11/0214 220/375
2,998,276 A * 8/1961 Shettler ..... B65F 1/1615 292/288
3,124,381 A * 3/1964 Geldart ..... B65F 1/1615 292/288
3,306,483 A * 2/1967 Bellafiore ..... B65D 35/42 24/304
4,339,056 A * 7/1982 Berkstresser, Jr. .... B65D 55/16 220/375
4,413,851 A * 11/1983 Ritter ..... B65F 1/1615 292/259 R
4,872,577 A 10/1989 Smith
4,976,371 A * 12/1990 Wise ..... B65D 45/02 292/288
5,150,808 A * 9/1992 Hamilton ..... B60K 15/0406 220/255
5,261,554 A * 11/1993 Forbes ..... B65D 81/3886 220/625
D342,449 S * 12/1993 Mattheis ..... D9/446
5,752,687 A 5/1998 Lynch
5,765,716 A 6/1998 Cai
6,059,136 A * 5/2000 Lin ..... B65D 45/32 220/212.5
6,070,769 A * 6/2000 Hornsby ..... B65D 25/48 138/109
6,085,931 A * 7/2000 Sadow ..... B65D 55/16 220/592.17
6,227,399 B1 * 5/2001 Angus ..... B65D 63/1027 215/901

(Continued)

FOREIGN PATENT DOCUMENTS

CA 2455993 A1 * 6/2005 ..... B65D 55/16
WO 2011039395 7/2011

*Primary Examiner* — Chun Hoi Cheung
*Assistant Examiner* — Brijesh V. Patel

(57) ABSTRACT

The leash system for use with a beverage container lid includes an anchor and a leash. The leash system for use with a beverage container lid may be used to tether a lid to a beverage container. The anchor may be coupled to the lid. The leash may detachably couple to the beverage container. An aperture located at a top end of the leash may detachably couple to an anchor tab on the anchor to prevent loss of the lid. A bottom end of the leash may detachably couple to a handle of the beverage container by virtue of the leash wrapping around the handle and passing through a slot located at the bottom end of the leash.

16 Claims, 5 Drawing Sheets

(56) References Cited

U.S. PATENT DOCUMENTS

| | | | | |
|---|---|---|---|---|
| 6,902,081 | B2 * | 6/2005 | Walker | B65F 1/1615 220/908 |
| 7,488,286 | B2 * | 2/2009 | James | A61B 1/2676 600/154 |
| 7,909,199 | B2 * | 3/2011 | Cahill | B65F 1/16 24/298 |
| 8,695,842 | B2 | 4/2014 | Gonzalez | |
| D776,487 | S | 1/2017 | Peeters | |
| 10,214,332 | B2 * | 2/2019 | Eyal | B65D 55/16 |
| 10,294,022 | B2 * | 5/2019 | Blazer | B65F 1/1615 |
| 2004/0056040 | A1 | 3/2004 | Ziegler | |
| 2005/0199631 | A1 * | 9/2005 | Alois | B65D 39/0005 220/375 |
| 2008/0230545 | A1 * | 9/2008 | Weene | B65D 25/20 29/700 |
| 2009/0134112 | A1 * | 5/2009 | Reeves | B65D 55/16 215/11.1 |
| 2010/0206879 | A1 | 8/2010 | Lin | |
| 2011/0219826 | A1 * | 9/2011 | Jeli | E05B 71/00 70/15 |
| 2011/0278216 | A1 * | 11/2011 | Hull | B65D 55/16 210/469 |
| 2015/0175352 | A1 * | 6/2015 | Jacobson | B65F 1/16 220/375 |
| 2016/0159538 | A1 * | 6/2016 | Michie | A45F 3/16 215/306 |

* cited by examiner

LEASH SYSTEM FOR USE WITH A BEVERAGE CONTAINER LID

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of beverage containers and tethering systems, more specifically, a leash system for use with a beverage container lid.

SUMMARY OF INVENTION

The leash system for use with a beverage container lid comprises an anchor and a leash. The leash system for use with a beverage container lid may be configured to tether a lid to a beverage container. The anchor may be coupled to the lid. The leash may detachably couple to the beverage container. An aperture located at a top end of the leash may detachably couple to an anchor tab on the anchor to prevent loss of the lid. A bottom end of the leash may detachably couple to a handle of the beverage container by virtue of the leash wrapping around the handle and passing through a slot located at the bottom end of the leash.

An object of the invention is to retain a lid to a beverage container.

Another object of the invention is to provide an anchor that couples to the lid of the beverage container.

A further object of the invention is to provide a leash that detachably couples to the handle of the beverage container.

Yet another object of the invention is to provide a leash that detachably couples to an anchor tab located on the anchor.

These together with additional objects, features and advantages of the leash system for use with a beverage container lid will be readily apparent to those of ordinary skill in the art upon reading the following detailed description of the presently preferred, but nonetheless illustrative, embodiments when taken in conjunction with the accompanying drawings.

In this respect, before explaining the current embodiments of the leash system for use with a beverage container lid in detail, it is to be understood that the leash system for use with a beverage container lid is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the leash system for use with a beverage container lid.

It is therefore important that the claims be regarded as including such equivalent construction insofar as they do not depart from the spirit and scope of the leash system for use with a beverage container lid. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
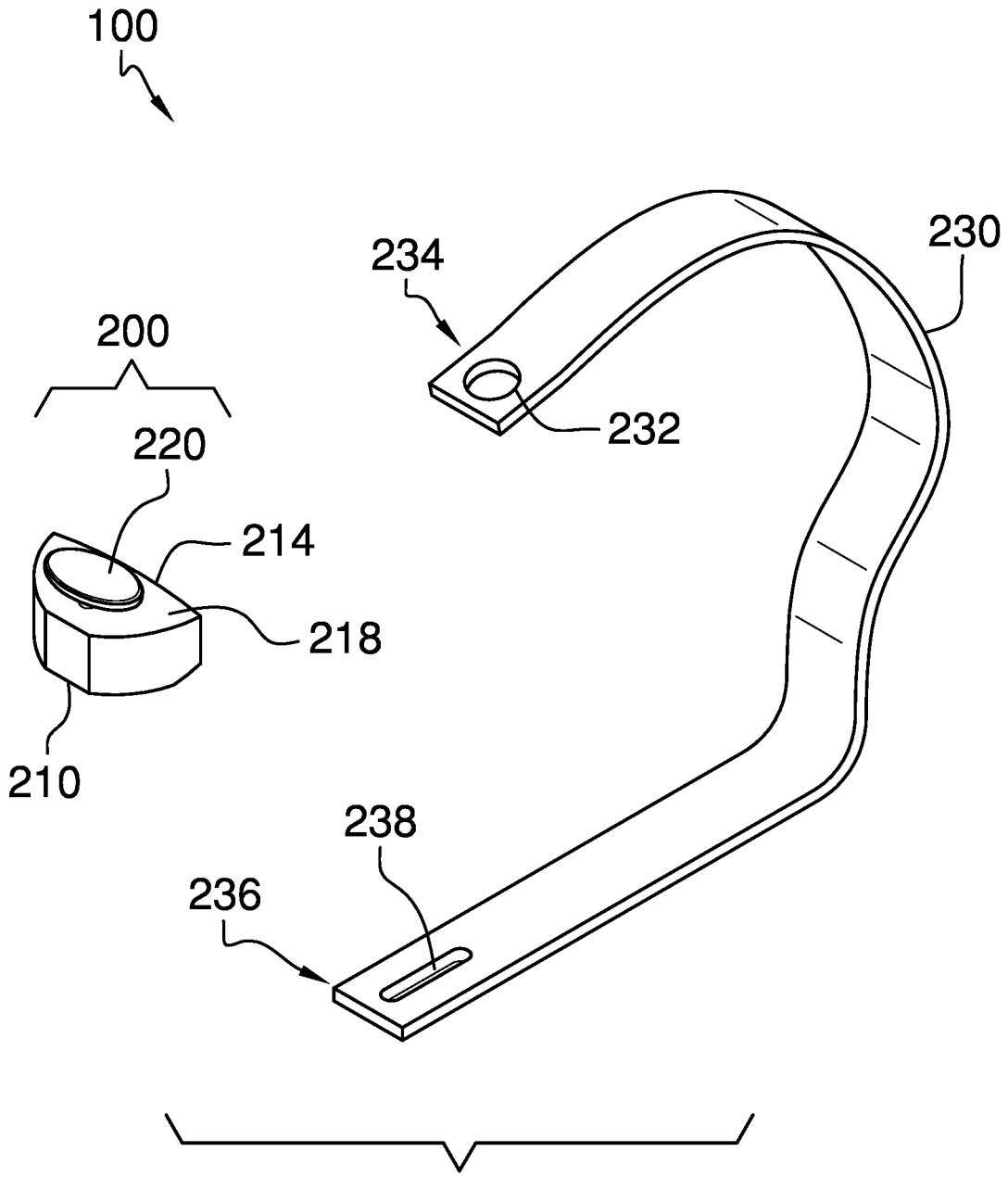
FIG. 1 is an isometric view of an embodiment of the disclosure.
Figure 2:
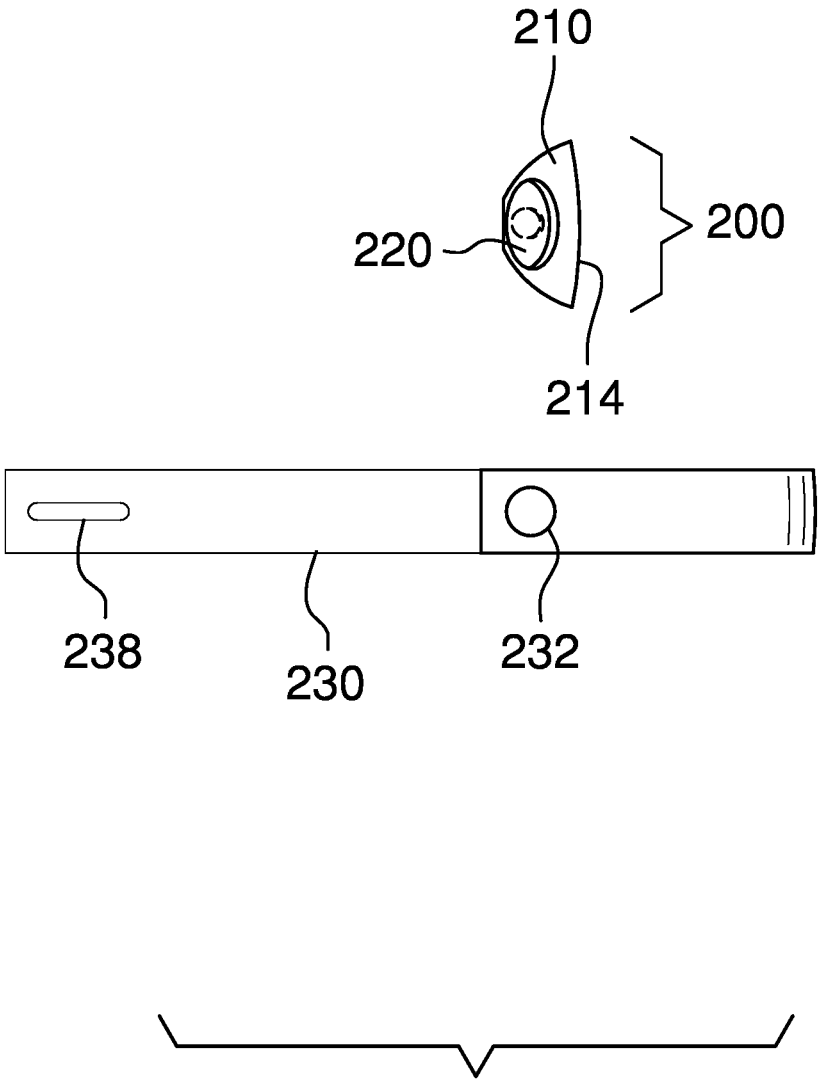
FIG. 2 is a top view of an embodiment of the disclosure.
Figure 3:
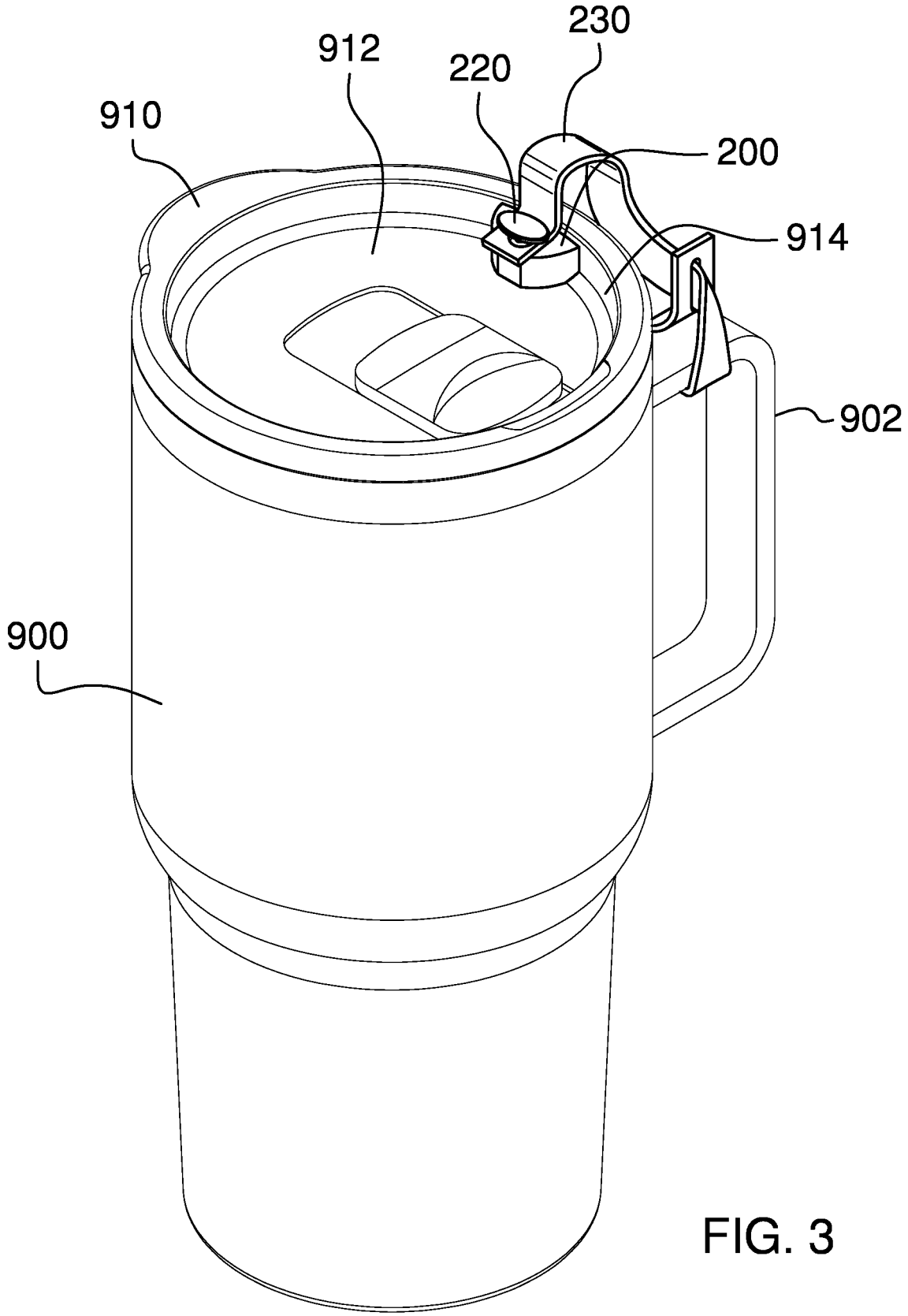
FIG. 3 is an in-use isometric view of an embodiment of the disclosure.
Figure 4:
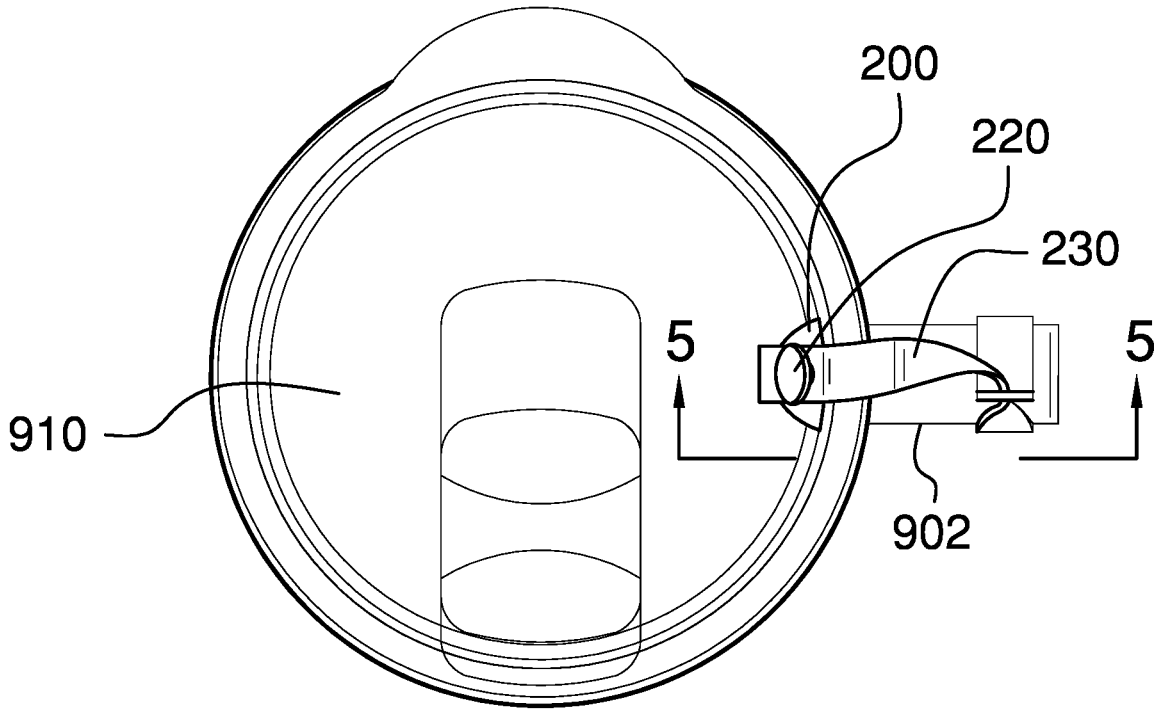
FIG. 4 is an in-use top view of an embodiment of the disclosure.
Figure 5:
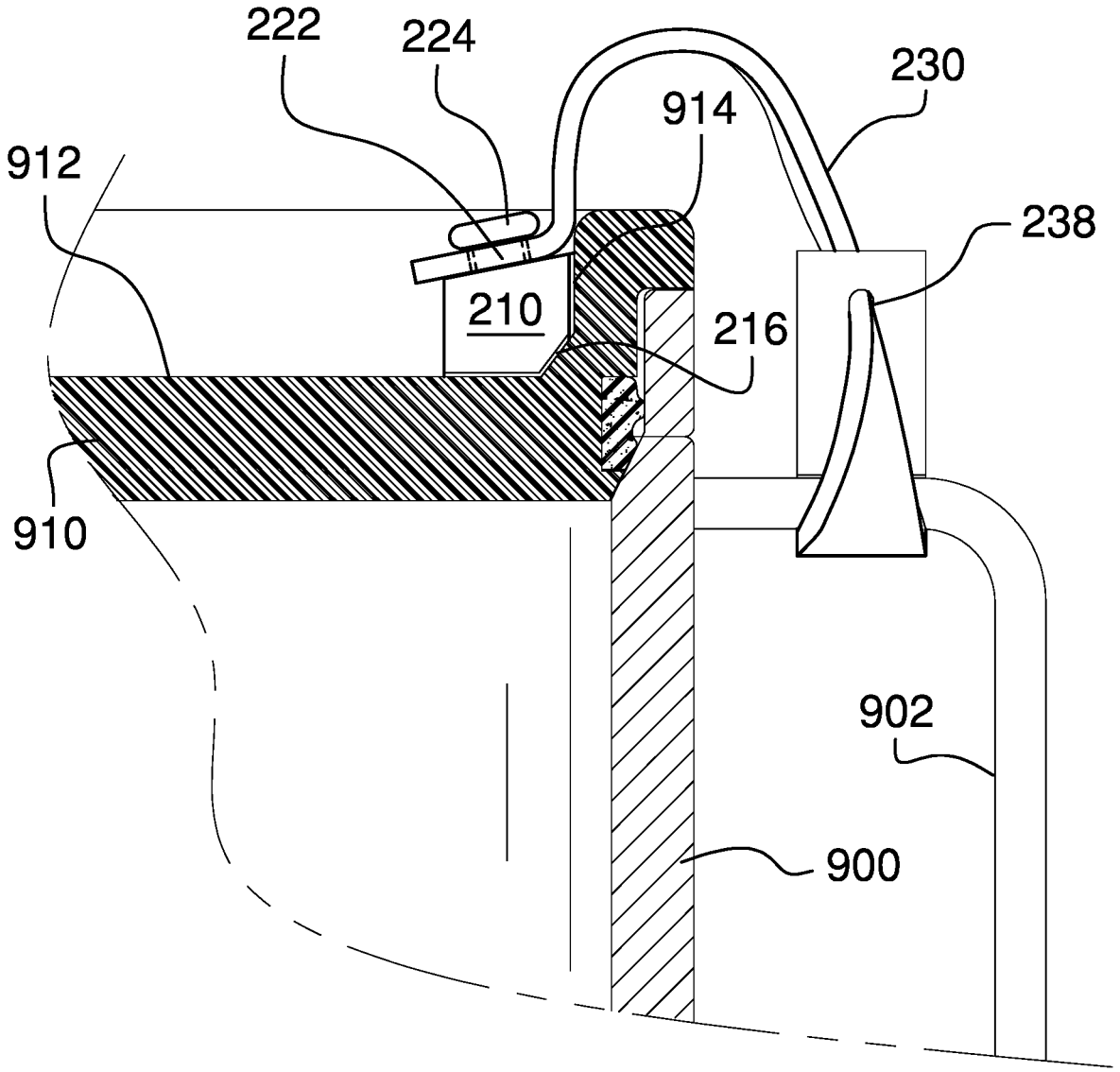
FIG. 5 is a cross-sectional view of an embodiment of the disclosure across 5-5 as shown in FIG. 4.

Detailed reference will now be made to a first potential embodiment of the disclosure, which is illustrated in FIGS. 1 through 5.

The leash system for use with a beverage container lid 100 (hereinafter invention) comprises an anchor 200 and a leash 230. The invention 100 may be configured to tether a lid 910 to a beverage container 900. The anchor 200 may be coupled to the lid 910. The leash 230 may detachably couple to the beverage container 900. An aperture 232 located at a top end 234 of the leash 230 may detachably couple to an anchor tab 220 on the anchor 200 to prevent loss of the lid 910. A bottom end 236 of the leash 230 may detachably couple to a handle 902 of the beverage container 900 by virtue of the leash 230 wrapping around the handle 902 and passing through a slot 238 located at the bottom end 236 of the leash 230.

The anchor 200 may comprise an anchor base 210 and the anchor tab 220. The anchor base 210 may be coupled to a lid top surface 912 and positioned against a lid top interior side wall 914. The anchor base 210 may be coupled to the lid 910 via an adhesive applied between the lid 910 and the anchor base 210.

The anchor base 210 may comprise a flat bottom to conform to the shape of the lid top surface 912. The anchor base 210 may comprise a curved rear side 214 to conform to the shape of the lid top interior side wall 914. In some embodiments, the curved rear side 214 may comprise a beveled corner 216 to conform to the shape of the lid 910.

An anchor base top surface 218 may be canted such that the anchor base top surface 218 is lower closer to the center of the lid 910 and higher closer to outside edge of the lid 910. The cant of the anchor base top surface 218 may orient the anchor tab 220 such that coupling the leash 230 to the anchor tab 220 is made easier.

The anchor tab 220 may comprise a shaft 222 and a head 224. The anchor tab 220 may comprise a T-shaped profile as seen from the side. The anchor tab 220 may be operable to retain the top end 234 of the leash 230.

The shaft 222 may extend upwards from the top of the anchor base 210. The top of the shaft 222 may comprise the head 224. The shaft 222 may be cylindrical. The head 224 may be a thickening of the top of the shaft 222. The aperture 232 in the leash 230 may pass over the head 224 and onto the shaft 222. The head 224 may prevent the leash 230 from lifting off of the anchor tab 220. The head 224 may comprise an oval footprint as seen from above such that the leash 230 must be deformed in order to slide onto or off of the anchor tab 220.

The leash 230 may be a flexible strap that retains the lid to the beverage container 900. The top end 234 of the leash 230 may comprise the aperture 232 that may detachably couple to the anchor tab 220 on the anchor 200. The aperture 232 may be round and may have a diameter that is larger than the diameter of the shaft 222 on the anchor tab 220 but smaller than the smallest diameter of the head 224 of the anchor tab 220. The bottom end 236 of the leash 230 may comprise the slot 238. The slot 238 may be longitudinally-oriented such that the slot 238 extends along the longitudinal axis of the leash 230. The width of the slot 238 may be wider than the thickness of the leash 230 and the length of the slot 238 may be longer than the width of the leash 230 such that the top end 234 of the leash 230 may pass through the slot 238. The leash 230 may retain the lid 910 to the beverage container 900 by passing the top end 234 of the leash 230 through the handle 902, by passing the top end 234 of the leash 230 through the slot 238, by pulling the top end 234 of the leash 230 to remove slack in the leash 230, and by coupling the top end 234 of the leash 230 to the anchor 200 using the aperture 232.

In a preferred embodiment, the width of the anchor base 210 may be ½ inch+/−1/16 inch. The depth of the anchor base 210 measured radially may be ¼ inch+/−1/16 inch. The maximum height of the anchor 200 as measured from the flat bottom to the top of the anchor tab 220 may be 3/16 inch+/−1/32 inch.

In use, an anchor 200 may be coupled to the lid 910 of the beverage container 900 using an adhesive and the leash 230 may be coupled to the handle 902 of the beverage container 900 by passing the top end 234 of the leash 230 through the handle 902, by passing the top end 234 of the leash 230 through the slot 238, and by pulling the top end 234 of the leash 230 to remove slack in the leash 230. The top end 234 of the leash 230 may then be coupled to the anchor 200 by placing the aperture 232 at the top end 234 of the leash 230 over the anchor tab 220 on the anchor 200. The lid 910 tethered in this manner may be difficult to lose.

DEFINITIONS

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface or object. Aperture may be synonymous with hole, slit, crack, gap, slot, or opening.

As used in this disclosure, a "cant" may be an angular deviation from one or more reference planes such as a vertical plane or a horizontal plane.

As used herein, the words "couple", "couples", "coupled" or "coupling", may refer to connecting, either directly or indirectly, and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, "flexible" may refer to an object or material which will deform when a force is applied to it, which will not return to its original shape when the deforming force is removed, and which may not retain the deformed shape caused by the deforming force.

As used here, "footprint" may refer to a projection of an object onto the surface that supports the object. The projection is usually, but not always, vertically downward.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used herein, "handle" may refer to an object or aperture by which a tool, object, or door is held or manipulated with the hand.

As used in this disclosure, the word "interior" may be used as a relational term that implies that an object is located or contained within the boundary of a structure or a space.

As used in this disclosure, a "lid" may be a movable or removable cover that is placed on a hollow structure to contain and/or protect the contents within the hollow structure.

As used herein, the word "longitudinal" or "longitudinally" may refer to a lengthwise or longest direction or to a direction that is perpendicular to the lateral direction.

As used in this disclosure, an "oval" may be a geometric shape that is formed in the shape of a flattened circle, similar in form to an ellipse. The shape may also sometimes be described as egg shaped. The difference between an oval and an ellipse is that an ellipse can be described by a mathematical formula while an oval has no such description.

As used in this disclosure, a "tab" may be an extension of an object for the purpose of facilitating the manipulation of the object, identifying the object, or attaching the object to another object.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A leash system comprising:
an anchor and a leash;
wherein the leash is configured to tether a lid to a beverage container;
wherein the anchor is configured to be coupled to the lid;
wherein the leash is configured to detachably couple to the beverage container;
wherein an aperture located at a top end of the leash is configured to detachably couple to an anchor tab on the anchor to prevent loss of the lid;
wherein a bottom end of the leash is configured to detachably couple to a handle of the beverage container by virtue of the leash wrapping around the handle of the beverage container and passing through a slot located at the bottom end of the leash;
wherein the anchor comprises an anchor base and the anchor tab;
wherein the anchor base is configured to be coupled to a lid top surface and positioned against a lid top interior side wall;
wherein the anchor base comprises a curved rear side that is configured to conform to the shape of the lid top interior side wall.

2. The leash system according to claim 1
wherein the anchor base is configured to be coupled to the lid via an adhesive applied between the lid and the anchor base.

3. The leash system according to claim 2
wherein the anchor base comprises a flat bottom to that is configured to conform to the shape of the lid top surface.

4. The leash system according to claim 3
wherein the curved rear side comprises a beveled corner to conform to the shape of the lid.

5. The leash system according to claim 4
wherein an anchor base top surface is canted such that the anchor base top surface is lower closer to the center of the lid and higher closer to outside edge of the lid;
wherein the cant of the anchor base top surface orients the anchor tab such that coupling the leash to the anchor tab is made easier.

6. The leash system according to claim 5
wherein the anchor tab comprises a shaft and a head;
wherein the anchor tab comprises a T-shaped profile as seen from the side;
wherein the anchor tab is operable to retain the top end of the leash.

7. The leash system according to claim 6
wherein the shaft extends upwards from the top of the anchor base;
wherein the top of the shaft comprises the head.

8. The leash system according to claim 7
wherein the shaft is cylindrical.

9. The leash system according to claim 8
wherein the head is a thickening of the top of the shaft.

10. The leash system according to claim 9
wherein the aperture in the leash passes over the head and onto the shaft;
wherein the head prevents the leash from lifting off of the anchor tab.

11. The leash system according to claim 10
wherein the head comprises an oval footprint as seen from above such that the leash must be deformed in order to slide onto or off of the anchor tab.

12. The leash system according to claim 11
wherein the leash is a flexible strap that retains the lid to the beverage container;
wherein the top end of the leash comprises the aperture that detachably couples to the anchor tab on the anchor.

13. The leash system according to claim 12
wherein the aperture is round and has a diameter that is larger than the diameter of the shaft on the anchor tab but smaller than the smallest diameter of the head of the anchor tab.

14. The leash system according to claim 13
wherein the bottom end of the leash comprises the slot;
wherein the slot is longitudinally-oriented such that the slot extends along the longitudinal axis of the leash.

15. The leash system according to claim 14
wherein the width of the slot is wider than the thickness of the leash and the length of the slot is longer than the width of the leash such that the top end of the leash pass through the slot.

16. The leash system according to claim 15
wherein the leash retains the lid to the beverage container by passing the top end of the leash through the handle of the beverage container, by passing the top end of the leash through the slot, by pulling the top end of the leash to remove slack in the leash, and by coupling the top end of the leash to the anchor using the aperture.

* * * * *